US012025412B2

(12) United States Patent
Maiorano

(10) Patent No.: US 12,025,412 B2
(45) Date of Patent: Jul. 2, 2024

(54) BALLOON TARGET APPARATUS AND METHOD

(71) Applicant: Giuseppe Maiorano, Belleville, NJ (US)

(72) Inventor: Giuseppe Maiorano, Belleville, NJ (US)

( * ) Notice: Subject to any disclaimer, the term of this patent is extended or adjusted under 35 U.S.C. 154(b) by 405 days.

(21) Appl. No.: 17/553,012

(22) Filed: Dec. 16, 2021

(65) Prior Publication Data

US 2023/0194219 A1 Jun. 22, 2023

(51) Int. Cl.

| | |
|---|---|
| ***F41J 3/00*** | (2006.01) |
| ***A63F 9/00*** | (2006.01) |
| ***F41J 1/10*** | (2006.01) |
| ***F41J 9/02*** | (2006.01) |

(52) U.S. Cl.

CPC ..... *F41J 3/0004* (2013.01); *A63F 9/0079* (2013.01); *F41J 1/10* (2013.01); *F41J 9/02* (2013.01); *A63F 2009/0084* (2013.01)

(58) Field of Classification Search

CPC .. F41J 1/10; F41J 3/0004; F41J 9/0079; F41J 2009/0083–0084; F41J 9/02; A63B 57/10; Y10S 411/923; Y10T 24/4696; F16B 15/0007; F16B 15/02; A63H 27/10; A63H 2027/1041; A63H 2027/1008; A63F 9/0079; A63F 2009/0083; A63F 2009/0084; A63F 57/10

USPC ..... D21/718; 446/222; 273/348, 406, 408

See application file for complete search history.

(56) References Cited

U.S. PATENT DOCUMENTS

| | | | | |
|---|---|---|---|---|
| 2,664,667 | A | 1/1954 | Burroughs | |
| 2,840,948 | A | 7/1958 | Stickley | |
| 3,846,873 | A * | 11/1974 | Saunders | F41J 3/0004 411/456 |
| 4,589,854 | A | 5/1986 | Smith | |
| 4,661,081 | A | 4/1987 | Basseches | |
| 4,895,545 | A | 1/1990 | Nelson | |
| 4,920,674 | A | 5/1990 | Shaeffer | |
| 5,021,022 | A | 6/1991 | Ganz | |
| D329,261 | S | 9/1992 | Pollack | |
| 5,203,530 | A | 4/1993 | Liu | |
| D360,844 | S | 8/1995 | Miller | |

(Continued)

FOREIGN PATENT DOCUMENTS

DE 10061523 A1 * 4/2002 ..... A63B 57/10

OTHER PUBLICATIONS

Jimmy Tippetts, "DIY Archery Target," Feb. 27, 2020, https://www.rokslide.com/diy-archery-target/, (Year: 2020).*

(Continued)

*Primary Examiner* — Joseph B Baldori

(74) *Attorney, Agent, or Firm* — Walter J. Tencza, Jr.

(57) ABSTRACT

A target apparatus including a post having a point on a first end, and an opposing second end; a plurality of support members, each having a first end connected to the second end of the post, and an opposing second end; and a central deflector having a point; and wherein each of the second ends of each of the plurality of support members is spaced apart from each of the other second ends of the plurality of support members; and wherein the central deflector is located within a perimeter defined by second ends of the plurality of support members. The target apparatus may further include a ring, which may be connected to the second ends of the plurality of support members.

21 Claims, 9 Drawing Sheets

(56) References Cited

U.S. PATENT DOCUMENTS

| | | | | |
|---|---|---|---|---|
| 6,430,804 | B1 | 8/2002 | Nelson | |
| 6,969,295 | B1 | 11/2005 | Sidwell | |
| D517,123 | S | 3/2006 | Sidwell | |
| D529,102 | S | 9/2006 | Sidwell | |
| 7,588,477 | B2 | 9/2009 | Sidwell | |
| RE41,056 | E | 12/2009 | Sidwell | |
| 8,968,047 | B1 | 3/2015 | Wicken et al. | |
| 9,849,360 | B2 * | 12/2017 | Carroll, Jr. ..... | A63B 57/10 |
| D831,126 | S | 10/2018 | Goodman-Pollack | |
| 10,279,277 | B2 | 5/2019 | Nelson | |
| 2007/0037473 | A1 | 2/2007 | Long, Jr. | |
| 2012/0228457 | A1 | 9/2012 | Gilbert | |

OTHER PUBLICATIONS

English machine translation of DE-10061523-A1 (Mayer) (Year: 2002).* https://www.mountedshootingsupplies.com/store/shooting-stars-target-bases-poles-moreinfo.html; Oct. 2, 2021.

* cited by examiner

BALLOON TARGET APPARATUS AND METHOD

FIELD OF THE INVENTION

This invention relates to devices for targets, particularly targets for archery.

BACKGROUND OF THE INVENTION

There are various known targets for archery.

SUMMARY OF THE INVENTION

In at least one embodiment, an apparatus and/or target apparatus is provided which may include a post having a point on a first end, and an opposing second end; a plurality of support members, each having a first end connected to the second end of the post, and an opposing second end; and a central deflector having a point; and wherein each of the second ends of each of the plurality of support members is spaced apart from each of the other second ends of the plurality of support members; and wherein the central deflector is located within a perimeter defined by second ends of the plurality of support members.

In at least one embodiment, the central deflector is located substantially at the center, or at the center, of the perimeter defined by the second ends of the plurality of support members. The apparatus may be further comprised of a ring; and the ring may be connected to the second ends of the plurality of support members.

In at least one embodiment, each of the plurality of support members has three elongated surfaces which extend from each first end to each second end of each of the plurality of support members, wherein at least two of the three elongated surfaces of each of the plurality of support members are flat.

The ring may have a flat three hundred and sixty degree front surface which is at an angle of between zero and ninety degrees with respect to the post. The at least two of the three flat elongated surfaces of each of the plurality of support members are angled at an angle between zero and ninety degrees either positive or negative and preferably about plus or minus forty-five degrees with respect to an overall elongated axis running through a length of the respective support member of each of the plurality of support members.

The central deflector may have three front flat surfaces which come together at the point of the central deflector. Each of the three front flat surfaces of the central deflector may be at an angle of between zero and ninety degrees either positive or negative with respect to the post.

In at least one embodiment, a method is provided which may include shooting an arrow at a target apparatus or apparatus may be constructed as previously described.

DETAILED DESCRIPTION OF THE DRAWINGS

Figure 1:
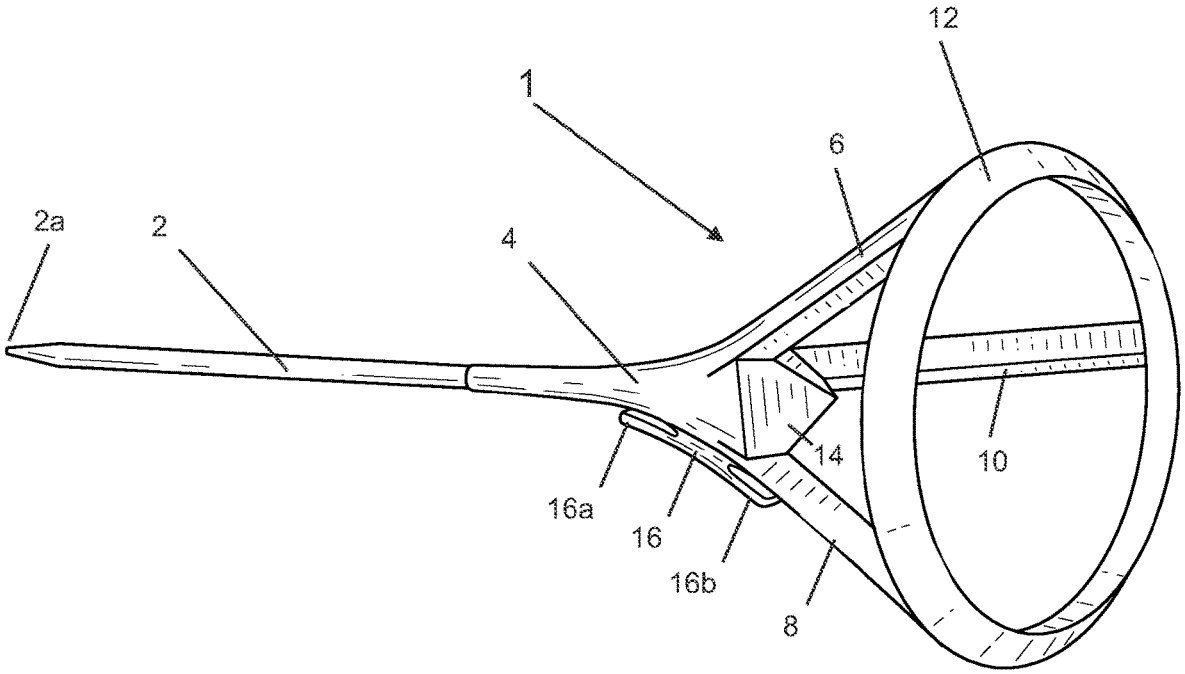
FIG. 1 is a front, top, and left perspective view of a balloon target apparatus in accordance with a first embodiment of the present invention.
Figure 2:
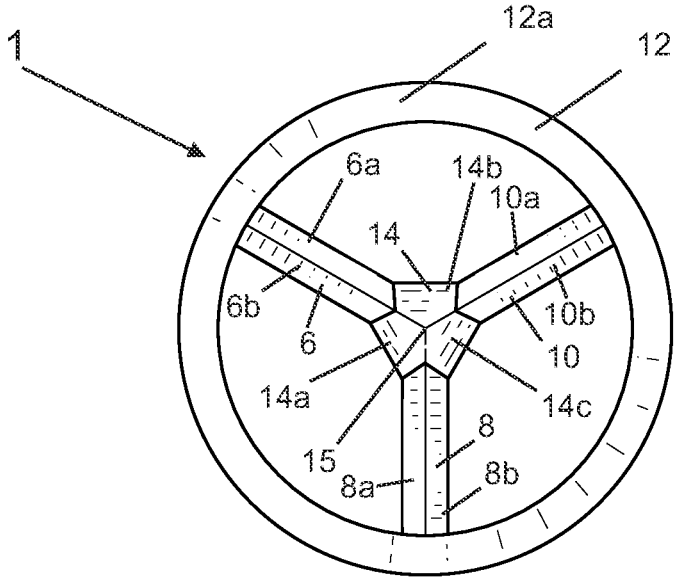
FIG. 2 is a front elevational view of the balloon target apparatus of FIG. 1.
Figure 3:
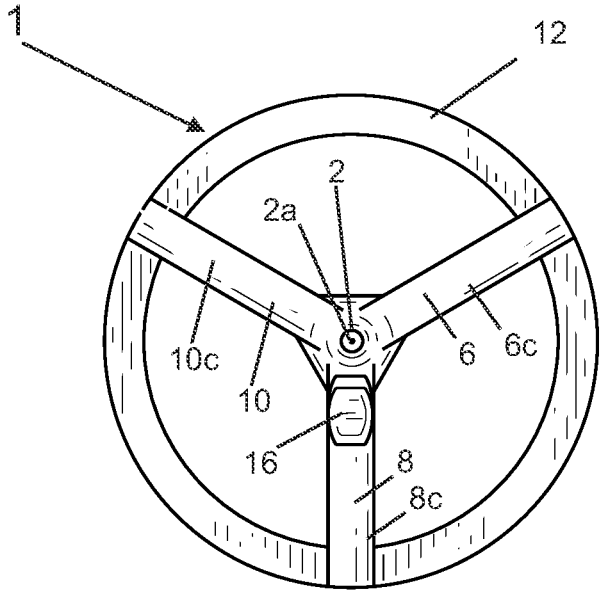
FIG. 3 is a rear elevational view of the balloon target apparatus of FIG. 1.
Figure 4:
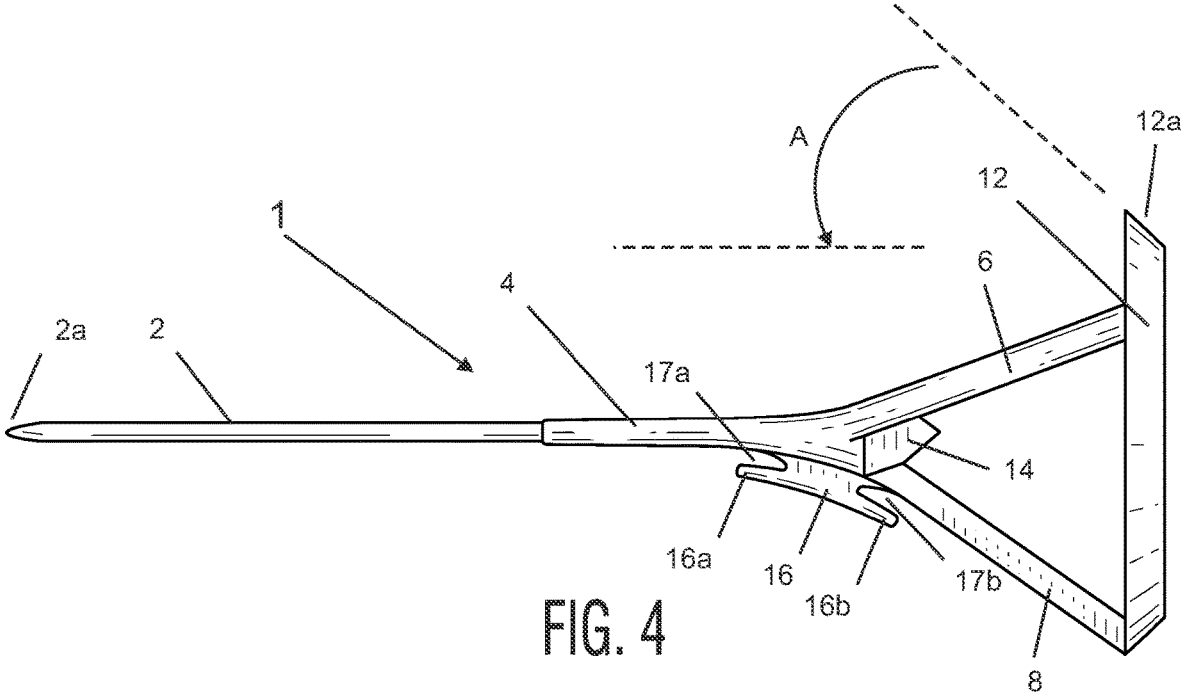
FIG. 4 is a left side elevational view of the balloon target apparatus of FIG. 1.
Figure 5:
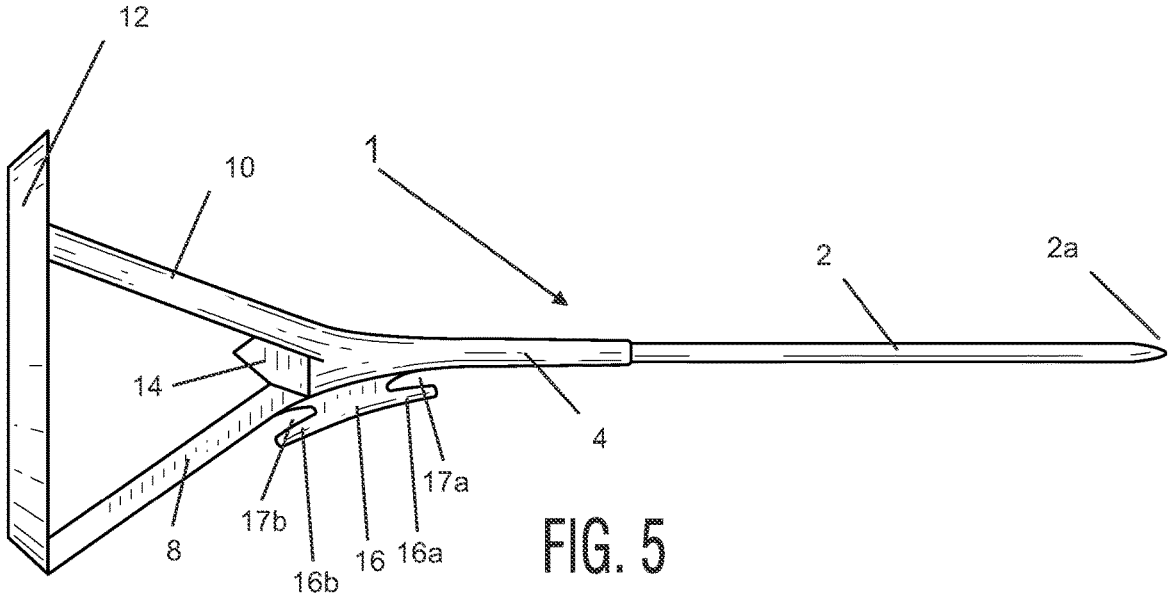
FIG. 5 is a right side elevational view of the balloon target apparatus of FIG. 1.
Figure 6:
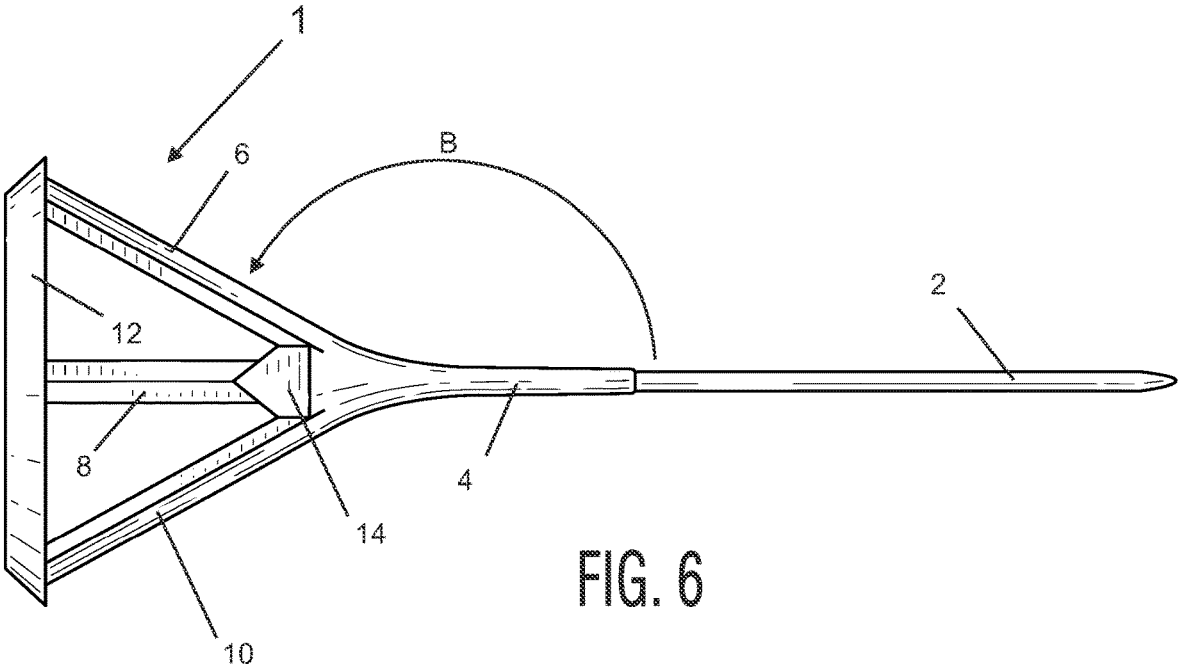
FIG. 6 is a top elevational view of the balloon target apparatus of FIG. 1.
Figure 7:
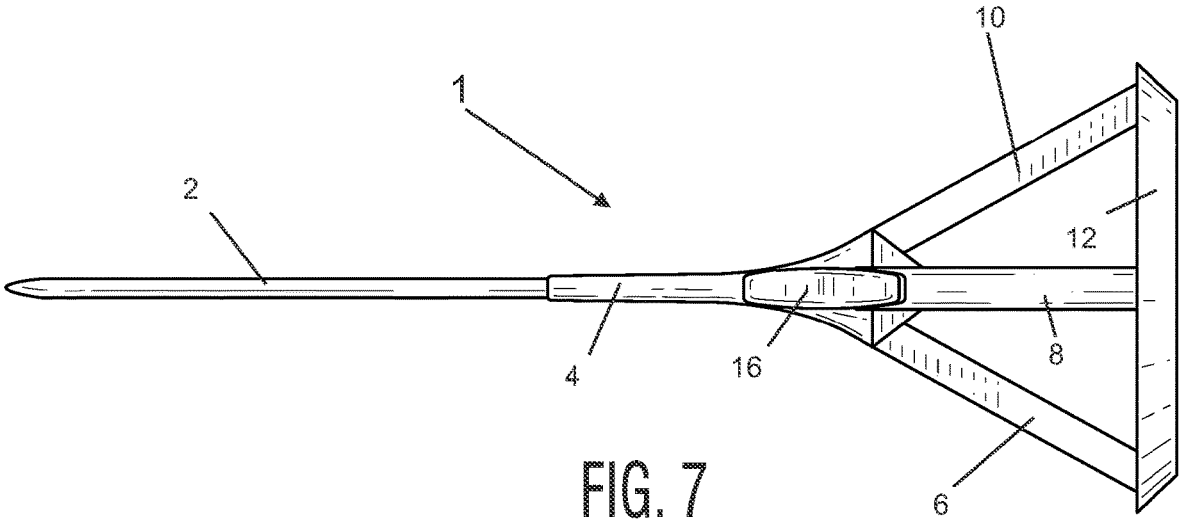
FIG. 7 is a bottom elevational view of the balloon target apparatus of FIG. 1.

FIG. 1 is a front, top, and left perspective view of a balloon target apparatus 1 in accordance with an embodiment of the present invention. FIG. 2 is a front elevational view of the balloon target apparatus 1 of FIG. 1. FIG. 3 is a rear elevational view of the balloon target apparatus 1 of FIG. 1. FIG. 4 is a left side elevational view of the balloon target apparatus 1 of FIG. 1. FIG. 5 is a right side elevational view of the balloon target apparatus 1 of FIG. 1. FIG. 6 is a top elevational view of the balloon target apparatus 1 of FIG. 1. FIG. 7 is a bottom elevational view of the balloon target apparatus 1 of FIG. 1.

Referring to FIGS. 1-7, the balloon target apparatus 1 includes a shaft or post 2, a tapered member 4, pointed member or central deflector 14 with a point or sharp edge 15 (shown in FIG. 2), a ring member 12, support members 6, 8, and 10, and an attachment member 16.

The shaft or post 2 has a point 2*a* at one end and is fixed and/or integrated with tapered member 4 at its opposite end.

The pointed member 14, has flat faces 14*a*, 14*b*, and 14*c* shown in FIG. 2, which come together at point or sharp edge 15. The support member 6 has front deflecting faces 6*a* and 6*b* which are at an angle with respect to each other as shown in FIG. 2, and rear flat face 6*c*, shown in FIG. 3. Similarly or identically, the support member 8 has front deflecting faces 8*a* and 8*b* which are at an angle with respect to each other as shown in FIG. 2, and rear flat face 8*c* shown in FIG. 3. Similarly or identically, the support member 10 has front deflecting faces 10*a* and 10*b* which are at an angle with respect to each other as shown in FIG. 2, and rear flat face 10*c*, shown in FIG. 3.

The attachment member 16 has protrusions or extensions 16*a* and 16*b*. There is a notch 17*a* formed between the extension or protrusion 16*a* and the member 4; and there is a notch 17*b* formed between the protrusion or extension 16*b* and the member 8, as shown in FIGS. 4 and 5.

Figure 8:
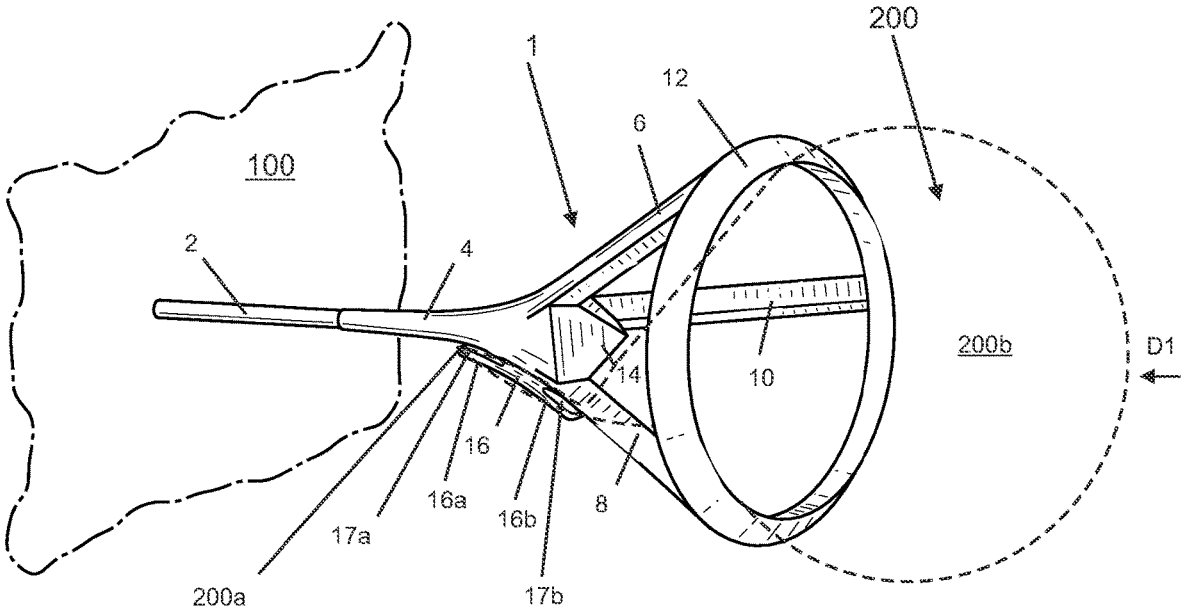
FIG. 8 is a front, top, and left perspective view of the balloon target apparatus of FIG. 1 inserted into a wall with the wall shown in broken lines.

FIG. 8 is a front, top, and left perspective view of the balloon target apparatus 1 of FIG. 1 inserted into a wall 100 with the wall 100 shown in broken lines. It is preferred in at least one embodiment, that the wall 100 may be, or may be replaced by an archery target, into which the balloon target apparatus 1 (or target apparatus 300 of FIGS. 9-15) is or will be inserted. FIG. 8 also shows dashed lines representing a balloon 200. The balloon may be a typical known balloon having an end 200*a,* into which air is inserted, wherein the end 200*a* is configured to be closed, after air is inserted into an inner chamber within a body portion, outer covering, or skin 200*b* of the balloon 200. The end 200*a* may be wrapped around the attachment member 16 by wedging the neck end of end 200*a* between and around notches 17*a* and 17*b* one or more times pending on the balloon size being used, and then placing the lips of the balloon 200*a* around members 16*a* and 16*b,* to thereby close and seal the end of the balloon 200*a,* eliminating the necessity of tying a knot at the end of the balloon 200*a.*

With the apparatus 1 inserted into the wall 100, and with a balloon 200 at least partially inserted and attached to the apparatus 1 as shown in FIG. 8, a person may shoot a field tipped arrow (practice tip from a bow and arrow) at the balloon 200 coming from the direction D1. The point 15 of the pointed member 14 is configured to deflect the arrow, after the arrow has gone through the balloon 200 and popped the balloon 200. The surfaces 10*a* and 10*b,* 6*a* and 6*b,* and 8*a* and 8*b,* respectively, come together in a sharp edge to also help deflect an arrows coming into the ring 12 from the direction D1. The point 15 and sharp edges of junctions of surfaces 10*a-b*, 6*a*-6*b,* and 8*a-b* help to preserve the apparatus 1 from being destroyed by the arrows coming through ring 12 from the direction D1, designating the apparatus 1 to be reusable for multiple shots.

The pointed member 14 is preferably made of a hard and/or resilient material ("resilient" such that the material is durable and will bounce back to its original shape or form) such as a solid metal, a solid shock resistive plastic polymer, or a combination of both materials, and in at least one or more embodiments it is critical that the pointed member 14 be made of one of said hard and/or resilient materials to effectively deflect an arrow shot from a bow.

Each of the members 6, 8, and 10 is preferably made of a hard and/or resilient material such as a solid metal, a solid shock resistive plastic polymer, or a combination of both materials, and in at least one or more embodiments it is critical that the members 6, 8, and 10 be made of one of said hard and/or resilient materials to effectively deflect an arrow shot from a bow.

Each of the members 2, 4, and 12 is preferably made of a hard and/or resilient material such as a solid metal, a solid shock resistive plastic polymer, or a combination of both materials, and in at least one or more embodiments it is critical that the members 2, 4, and 12 be made of one of said hard and/or resilient materials to effectively deflect an arrow shot from a bow.

The attachment member 16 is preferably made of the same or a similar hard and/or resilient material, such as used for members 14, 6, 8, 10, 2, 4, and 12, and the attachment member is aligned with and underneath the member 8 to prevent damage to the attachment member 16.

The target apparatus 1 may be used for purposes other than archery, however, it is particularly useful for archery. The combination of the balloon 200, apparatus 1 and wall 100, provide a target that gives both a visual and a sound indication of when a target has been hit. The balloon 200, when the target is hit, makes a "pop" noise and also deflates providing a visual and sound indication.

There is an angle A, shown in FIG. 4 between a flat front surface 12*a* of the ring 12 and the post 2. The angle A is preferably between zero and ninety degrees, and in one or more embodiments, is preferably about forty five degrees, and this helps to deflect arrows which impact on the surface 12*a* of the ring 12. The flat front surface 12*a* of the ring 12 surrounds an entire three hundred sixty degree perimeter and the pointed member or deflector 14 lies within the perimeter defined by the ring 12 and the flat front surface 12*a*. In at least one embodiment, it is preferred that the deflector 14 and particularly the point 15 lie at the center or are substantially centrally located within the three hundred and sixty degree perimeter of the ring 12 and of the flat front surface 12*a* as shown in FIG. 2.

In addition, it is preferred in at least one embodiment, that an elongated overall axis passing entirely, and centrally, through each of the support members 6, 8, and 10 be at an angle B, shown (for support member 6 in FIG. 6), of one hundred and thirty five degrees (135 degrees) with respect to the post 2. In addition, it is preferred in at least one embodiment that front face surfaces 6*a* and 6*b,* shown in FIG. 2, are at an angle of about plus and minus, respectively, less than ninety degrees, and preferably plus and minus, respectively, forty-five degrees with respect to the elongated overall axis passing entirely, and centrally through support member 6. Similarly, or identically, it is preferred in at least one embodiment that front face surfaces 8*a* and 8*b,* shown in FIG. 2, are at an angle of about plus and minus, respectively, less than ninety degrees, and preferably plus and minus, respectively, forty-five degrees with respect to the elongated overall axis passing entirely, and centrally through support member 8. Similarly, or identically, it is preferred in at least one embodiment that front face surfaces 10*a* and 10*b,* shown in FIG. 2, are at an angle of about plus and minus, respectively, less than ninety degrees, and preferably plus and minus, respectively, forty-five degrees with respect to the elongated overall axis passing entirely, and centrally through support member 10. These angles are provided to enhance deflection of an arrow shot in the direction of D1, shown in FIG. 8, towards the target 1 of FIGS. 1-8 or the target 300 of FIGS. 9-15.

In at least one embodiment, the three front flat surfaces 14*a,* 14*b,* and 14*c,* shown in FIG. 2 are preferably at an angle of plus or minus less than ninety degrees with respect to the post 2. In at least one embodiment, the three front flat surfaces 14*a,* 14*b,* and 14*c* shown in FIG. 2 are preferably at an angle of plus or minus about forty-five degrees with respect to the post 2. The three front flat surfaces 14*a-c* come together at point 15, and form a triangular prism like structure in at least one embodiment.

Figure 9:
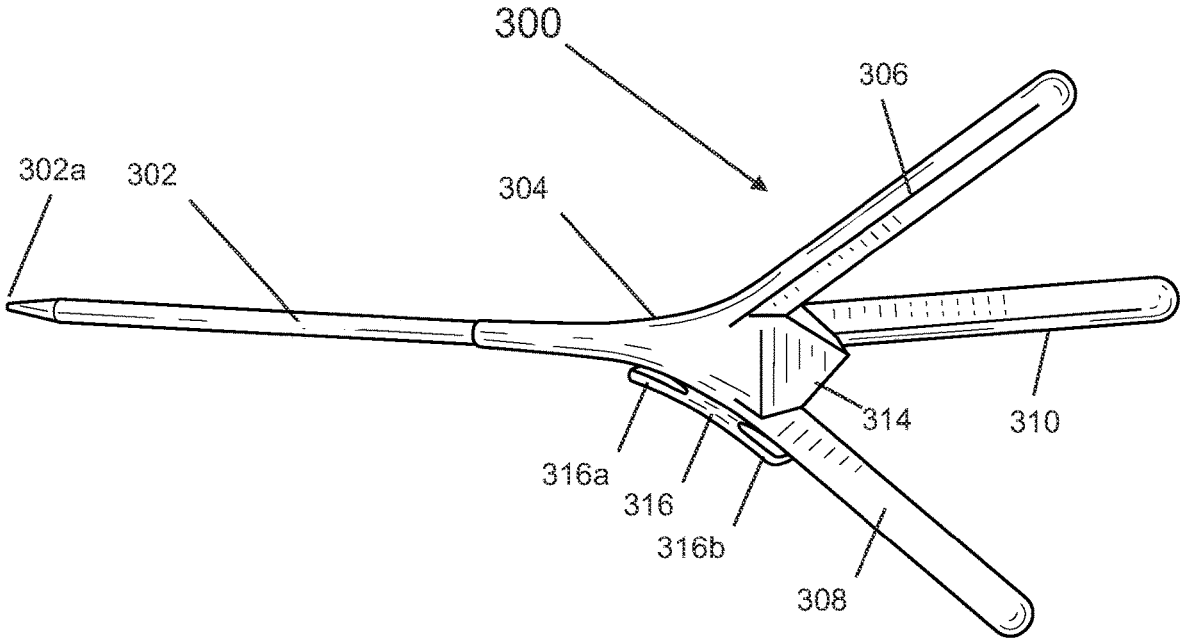
FIG. 9 is a front, top, and left perspective view of a balloon target apparatus in accordance with a second embodiment of the present invention.
Figure 10:
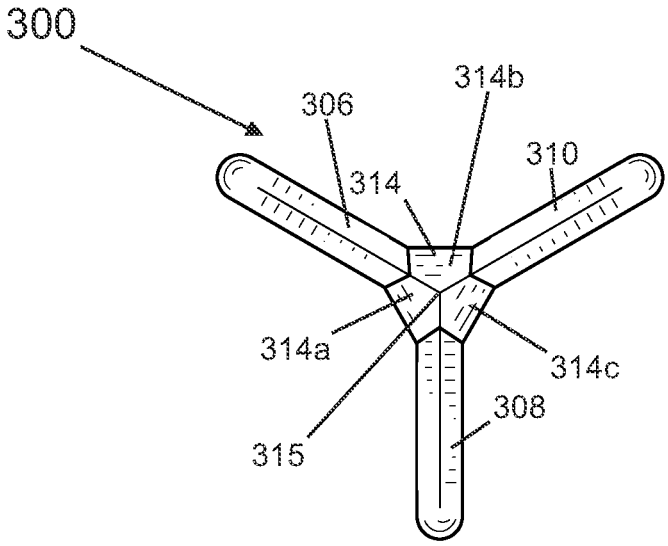
FIG. 10 is a front elevational view of the balloon target apparatus of FIG. 9.
Figure 11:
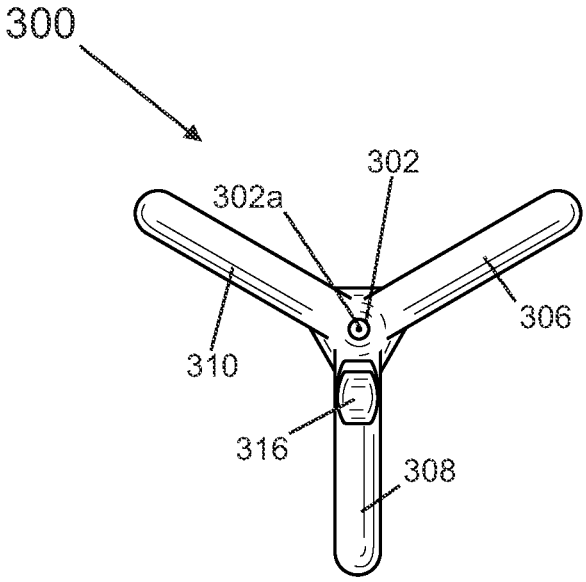
FIG. 11 is a rear elevational view of the balloon target apparatus of FIG. 9.
Figure 12:
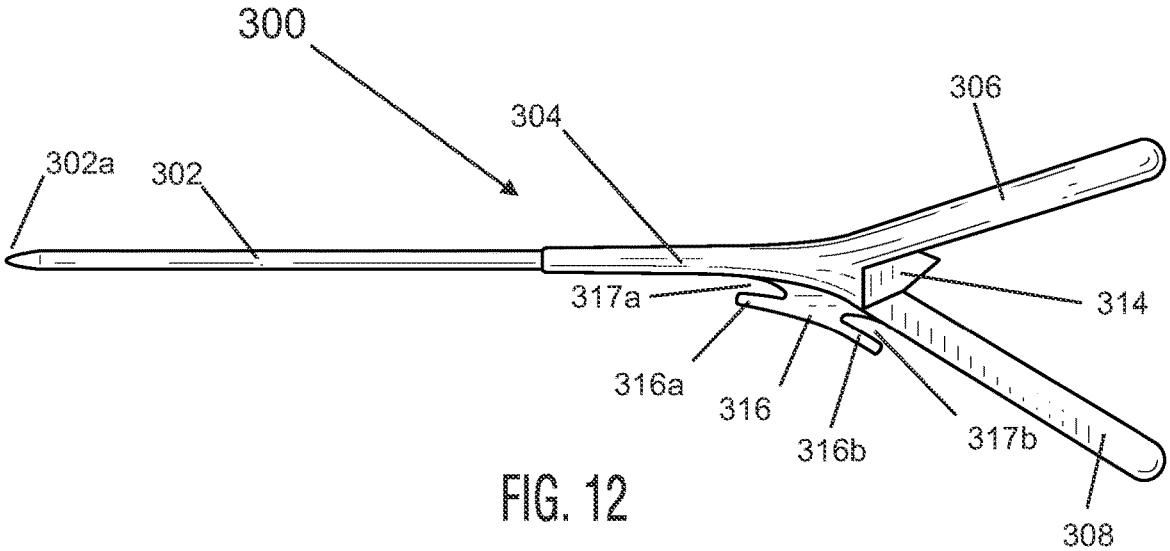
FIG. 12 is a left side elevational view of the balloon target apparatus of FIG. 9.
Figure 13:
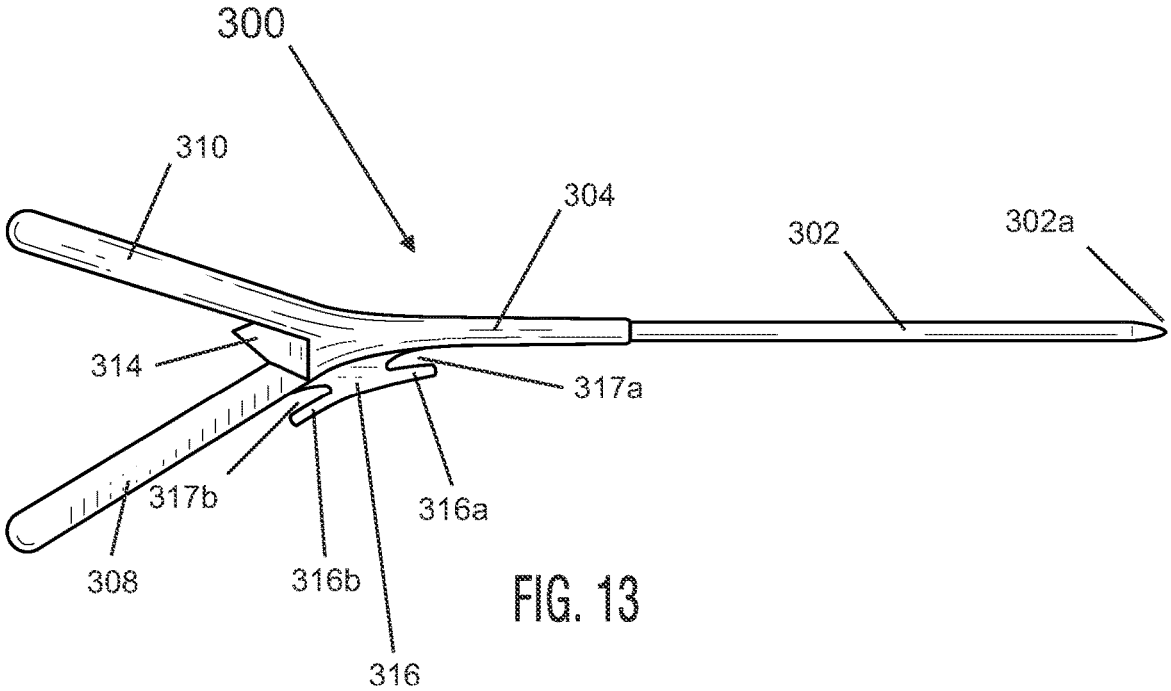
FIG. 13 is a right side elevational view of the balloon target apparatus of FIG. 9.
Figure 14:
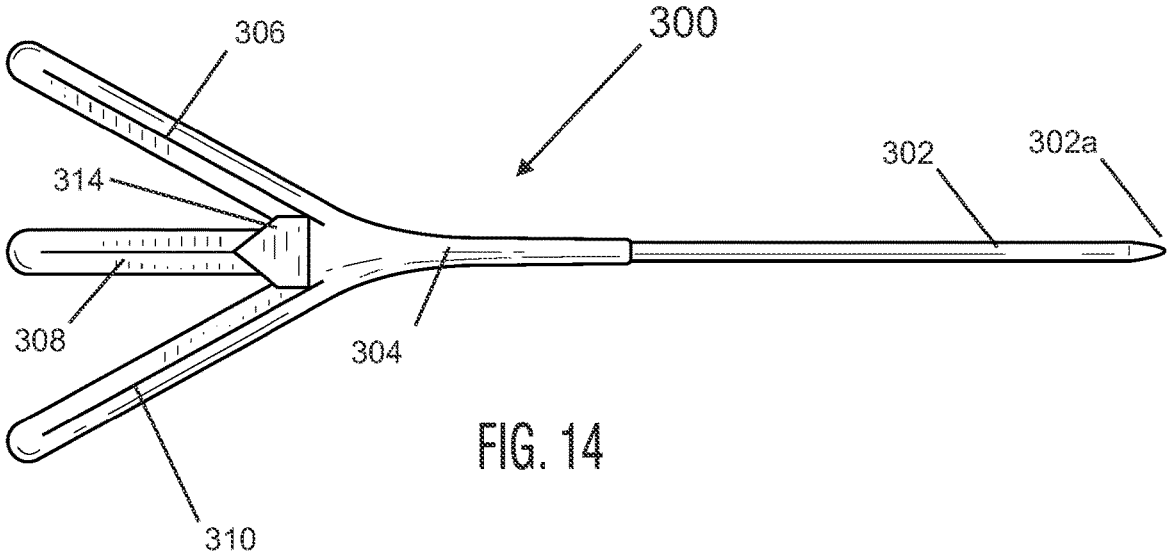
FIG. 14 is a top elevational view of the balloon target apparatus of FIG. 9.
Figure 15:
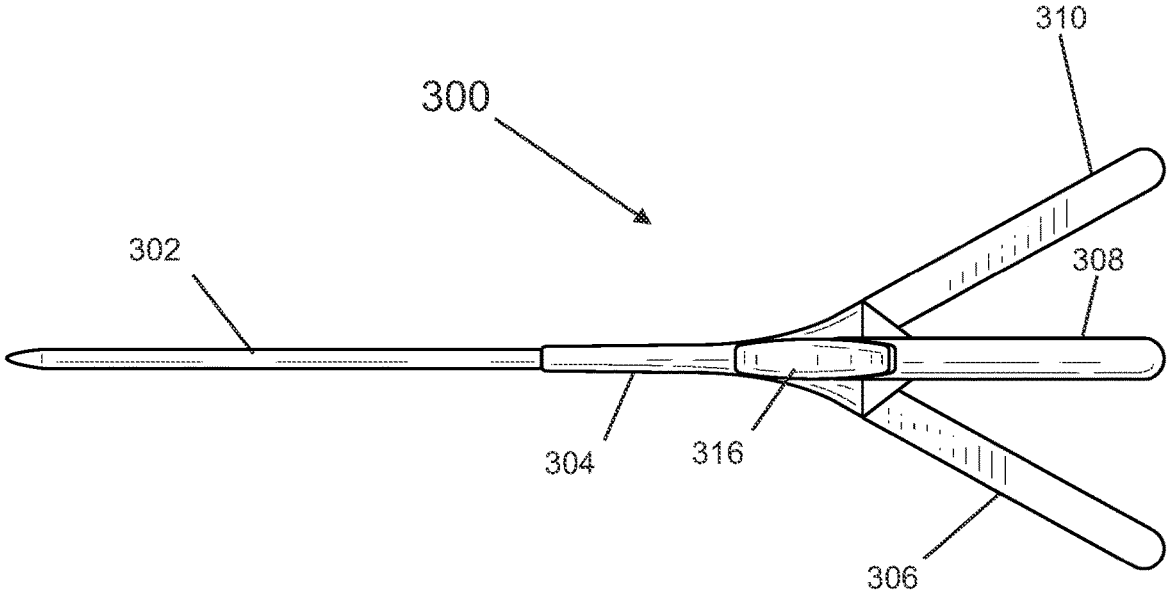
FIG. 15 is a bottom elevational view of the balloon target apparatus of FIG. 9.

FIG. 9 is a front, top, and left perspective view of a balloon target apparatus 300 in accordance with an embodiment of the present invention. FIG. 10 is a front elevational view of the balloon target apparatus 300 of FIG. 9. FIG. 11 is a rear elevational view of the balloon target apparatus 300 of FIG. 9. FIG. 12 is a left side elevational view of the balloon target apparatus 300 of FIG. 9. FIG. 13 is a right side elevational view of the balloon target apparatus 300 of FIG. 9. FIG. 14 is a top elevational view of the balloon target apparatus 300 of FIG. 9. FIG. 15 is a bottom elevational view of the balloon target apparatus 300 of FIG. 9.

Referring to FIGS. 9-15, the balloon target apparatus 300 includes a shaft or post 302, a tapered member 304, pointed member or central deflector 314 with a point or sharp edge 315 (shown in FIG. 10), support members 306, 308, and 310, and an attachment member 316.

The shaft or post 302 has a point 302*a* at one end and is fixed and/or integrated with tapered member 304 at its opposite end.

The pointed member 314, has flat faces 314*a,* 314*b,* and 314*c* shown in FIG. 10, which come together at point or sharp edge 315. The support member 306 may have front deflecting faces, similar or identical to faces 6*a* and 6*b* of apparatus 1, which are at an angle with respect to each other as shown in FIG. 2, and a rear flat face, similar to 6*c* of apparatus 1, shown in FIG. 3. Similarly or identically, the support member 308 may have front deflecting faces similar to faces 8*a* and 8*b* of apparatus 1 which are at an angle with respect to each other as shown in FIG. 2, and a rear flat face similar or identical to 8*c* shown in FIG. 3. Similarly or identically, the support member 310 may have front deflecting faces, similar or identical to faces 10*a* and 10*b* of apparatus 1 which are at an angle with respect to each other as shown in FIG. 2, and a rear flat face, similar or identical to face 10*c,* shown in FIG. 3.

The attachment member 316 has protrusions or extensions 316*a* and 316*b*. There is a notch 317*a* formed between the extension or protrusion 316*a* and the member 304; and there is a notch 317*b* formed between the protrusion or extension 316*b* and the member 308, as shown in FIGS. 12 and 13.

The apparatus 300 may be used in a manner similar or identical to the apparatus 1, to insert apparatus 300 into a wall 100, similar or identically to as shown in FIG. 8. A balloon, such as balloon 200 may be attached to the apparatus 300, similar or identical to as shown for apparatus 1 in FIG. 8. The end 200*a* of the balloon 200 may be wrapped around the attachment member 316 by wedging the neck end of 200*a* between and around notches 317*a* and 317*b* one or more times pending on the balloon size being used, and then placing the lips of the balloon 200*a* around members 316*a* and 316*b,* to thereby close and seal the end of the balloon 200*a*, eliminating the necessity of tying a knot at the end of the balloon 200*a,* similar or identical to as shown for apparatus 1, in FIG. 8.

With the apparatus 300 or the apparatus 1 inserted into the wall 100, and with a balloon 200 at least partially inserted and attached to the apparatus 1 or 300 as shown in FIG. 8 (similar or identical to FIG. 8 for apparatus 300), a person may shoot a "field tipped arrow" (practice tip from a bow and arrow) at the balloon 200 coming from the direction D1 shown in FIG. 8. The point 15 (or 315) of the pointed member 14 (or 314) is configured to deflect the arrow, after the arrow has gone through the balloon 200 and popped the balloon 200. The surfaces 10*a* and 10*b*, 6*a* and 6*b,* and 8*a* and 8*b,* respectively, (or corresponding surfaces of members 310, 306, and 308) come together in a sharp edge to also help deflect arrows coming into the ring 12 (or in between a region defined by members 306, 308, and 310) from the direction D1, which allows the apparatus 1 and/or 300 to be reusable for multiple shots. The point 15 (or 315) and sharp edges of junctions of surfaces 10*a-b*, 6*a*-6*b,* and 8*a-b* (or analogous surfaces of members 310, 306, and 308) help to preserve the apparatus 1 (or 300) from being destroyed by the arrows coming through ring 12 (or through a region between and/or defined by members 306, 308, and 310) from the direction D1.

The pointed member 314, the members 306, 308, 310, 302, and 304, and the attachment member 316 are preferably made of similar or identical hard and/or resilient materials as the pointed member 14, the members 6, 8, 10, 2, and 4, and the attachment member 16, respectively.

The target apparatus 1 or the target apparatus 300 may be used for purposes other than archery, however, it is particularly useful for archery. The combination of the balloon 200, apparatus 1 (or 300) and the wall 100, provide a target that gives both a visual and a sound indication of when a target has been hit. The balloon 200, when the target is hit, makes a "pop" noise and also deflates providing a visual and sound indication.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A target apparatus comprising:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by the second ends of the plurality of support members; and wherein the central deflector has three front flat surfaces which come together at the point of the central deflector.

2. The target apparatus of claim 1 wherein the central deflector is located substantially at the center of the perimeter defined by the second ends of the plurality of support members.

3. The target apparatus of claim 1 wherein the central deflector is located at the center of the perimeter defined by the second ends of the plurality of support members.

4. The target apparatus of claim 1 further comprising a ring; and wherein the ring is connected to the second ends of the plurality of support members.

5. The target apparatus of claim 1 wherein each of the plurality of support members has three elongated surfaces which extend from each first end to each second end of each of the plurality of support members, wherein at least two of the three elongated surfaces of each of the plurality of support members are flat.

6. The target apparatus of claim 5 wherein the at least two of the three flat elongated surfaces of each of the plurality of support members are angled with respect to each other.

7. The target apparatus of claim 5 wherein the at least two of the three flat elongated surfaces of each of the plurality of support members are angled at an angle of about ninety degrees with respect to each other.

8. A target apparatus comprising:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by second ends of the plurality of support members; and further comprising a ring;

wherein the ring is connected to the second ends of the plurality of support members;

wherein the ring has a flat three hundred and sixty degree front surface which is at an angle of about forty-five degrees with respect to the post.

9. A target apparatus comprising:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by second ends of the plurality of support members;

and further comprising an attachment member having at least one notch, wherein the attachment member is located between the first end of the post and the perimeter, and wherein the attachment member is configured to attach a portion of an object to the target member, while another portion of the object is located within the perimeter.

10. The target apparatus of claim 1 wherein each of the three front flat surfaces are at an angle of between zero and ninety degrees with respect to a longitudinal axis of the post.

11. A method comprising shooting an arrow at a target apparatus, wherein the target apparatus comprises:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by the second ends of the plurality of support members; and wherein the central deflector has three front flat surfaces which come together at the point of the central deflector.

12. The method of claim 11 wherein the central deflector is located substantially at the center of the perimeter defined by the second ends of the plurality of support members.

13. The method of claim 11 wherein the central deflector is located at the center of the perimeter defined by the second ends of the plurality of support members.

14. The method of claim 11 wherein the target apparatus further comprises:

a ring; and wherein the ring is connected to the second ends of the plurality of support members.

15. The method of claim 11 wherein each of the plurality of support members has three elongated surfaces which extend from each first end to each second end of each of the plurality of support members, wherein at least two of the three elongated surfaces of each of the plurality of support members are flat.

16. The method of claim 15 wherein the at least two of the three flat elongated surfaces of each of the plurality of support members are angled with respect to each other.

17. The method of claim 15 wherein the at least two of the three flat elongated surfaces of each of the plurality of support members are angled at an angle of about ninety degrees with respect to each other.

18. The method of claim 11 wherein each of the three front flat surfaces are at an angle of between zero and ninety degrees with respect to a longitudinal axis of the post.

19. A method comprising shooting an arrow at a target apparatus, wherein the target apparatus comprises:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by second ends of the plurality of support members;

wherein the target apparatus is further comprised of a ring; wherein the ring is connected to the second ends of the plurality of support members; and wherein the ring has a flat three hundred and sixty degree front surface which is at an angle of about forty-five degrees with respect to a longitudinal axis of the post.

20. A method comprising shooting an arrow at a target apparatus, wherein the target apparatus comprises:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by second ends of the plurality of support members; and wherein the target apparatus further includes an attachment member having at least one notch, wherein the attachment member is located between the first end of the post and the perimeter, and wherein the attachment member is configured to attach a portion of an object to the target member, while another portion of the object is located within the perimeter.

21. An apparatus comprising:

a target apparatus comprising:

a post having a point on a first end, and an opposing second end;

a plurality of support members, each having a first end connected to the second end of the post, and an opposing second end; and a central deflector having a point;

and wherein each of the second ends of each of the plurality of support members is spaced apart from each of the other second ends of the plurality of support members;

wherein the central deflector is located within a perimeter defined by the second ends of the plurality of support members; and the apparatus further comprising a balloon; and wherein a lip of the balloon is configured to be attached at a location between the first end of the post and the perimeter of the target apparatus, while a portion of the balloon, is within the perimeter of the target apparatus.

* * * * *